US010876231B2

(12) United States Patent
Idobata

(10) Patent No.: US 10,876,231 B2
(45) Date of Patent: Dec. 29, 2020

(54) WEFT KNITTED FABRIC HAVING THICK PORTION AND KNITTING METHOD FOR THE SAME

(71) Applicant: KNITIDO CO., LTD., Wakayama (JP)

(72) Inventor: Yasuhiro Idobata, Wakayama (JP)

(73) Assignee: KNITIDO CO., LTD., Wakayama (JP)

( * ) Notice: Subject to any disclaimer, the term of this patent is extended or adjusted under 35 U.S.C. 154(b) by 56 days.

(21) Appl. No.: 16/212,878

(22) Filed: Dec. 7, 2018

(65) Prior Publication Data

US 2019/0203390 A1 Jul. 4, 2019

(30) Foreign Application Priority Data

Dec. 28, 2017 (JP) ..... 2017-253077

(51) Int. Cl.

*D04B 1/24* (2006.01)
*D04B 1/10* (2006.01)
*D04B 1/18* (2006.01)
*D04B 1/26* (2006.01)
(Continued)

(52) U.S. Cl.

CPC ..... *D04B 1/24* (2013.01); *A41B 11/00* (2013.01); *D04B 1/102* (2013.01); *D04B 1/108* (2013.01); *D04B 1/18* (2013.01); *D04B 1/26* (2013.01); *A41B 11/02* (2013.01); *A41B 2500/10* (2013.01); *D10B 2403/02* (2013.01); *D10B 2501/02* (2013.01)

(58) Field of Classification Search

CPC . D04B 1/24; D04B 1/18; D04B 1/108; D04B 1/26; D04B 1/102; D04B 1/00; A41B 11/00; A41B 11/02; A41B 2500/10; D10B 2403/02; D10B 2501/02; D10B 2501/021

USPC ..... 66/178 R, 185

See application file for complete search history.

(56) References Cited

U.S. PATENT DOCUMENTS 4,732,015 A * 3/1988 Abrams ..... D04B 1/102 66/172 E
4,797,311 A * 1/1989 Kemp ..... D04B 1/102 428/92

(Continued)

FOREIGN PATENT DOCUMENTS

EP 1 887 116 2/2008
JP 6-158483 6/1994

(Continued)

OTHER PUBLICATIONS

Jeong Seon Sang et al., "Knit Structure and Properties of High Stretch Compression Garments", The Korean Fiber Society, Department of Clothing and Textiles, Hanyang University, Seoul, Korea, 2013, XP002793340 with English abstract.

*Primary Examiner* — Danny Worrell
*Assistant Examiner* — Aiying Zhao
(74) *Attorney, Agent, or Firm* — Wenderoth, Lind & Ponack, L.L.P.

(57) ABSTRACT

A knitting method is for forming a weft knitted fabric having a thick portion. The knitting method includes a thick portion knitting step of forming at least two complete thick portion textures in one course of the weft knitted fabric by continuously repeating a thick portion knitting substep while alternating horizontal yarn feeding directions, the thick portion knitting substep including feeding a knitting yarn once to a needle row of five successive knitting needles in one horizontal direction.

2 Claims, 13 Drawing Sheets

(51) Int. Cl.
*A41B 11/00* (2006.01)
*A41B 11/02* (2006.01)

(56) References Cited

U.S. PATENT DOCUMENTS

| | | | | |
|---|---|---|---|---|
| 6,715,325 | B2 * | 4/2004 | Sangiacomo | D04B 9/12 66/107 |
| 2009/0100877 | A1 | 4/2009 | Kaneda | |
| 2009/0100878 | A1 * | 4/2009 | Miyai | D04B 1/102 66/192 |

FOREIGN PATENT DOCUMENTS

| | | | |
|---|---|---|---|
| JP | 2004124291 | A * | 4/2004 |
| JP | 2009-150007 | | 7/2009 |
| JP | 6230733 | | 11/2017 |

* cited by examiner

FIG. 2

| #1 | #2 | #3 | #4 | #5 | Knitting method | | |

FIG. 3

| #1 | #2 | #3 | #4 | #5 | Knitting method | | |

FIG. 4

| #1 | #2 | #3 | #4 | #5 | Knitting method | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| C46 ~ C47 | S20 | S2010 | B | ← | ▲ | — | ● | — | — | ▲ | — | ● | — | — | ▲ | — | | | | | | | | | | | | | | | | |
| | | S2009 | B | → | — | ▲ | — | ● | — | — | ▲ | — | ● | — | — | ▲ | | | | | | | | | | | | | | | | |
| | | S2008 | B | ← | — | — | ▲ | — | ● | — | — | ▲ | — | ● | — | — | | | | | | | | | | | | | | | | |
| | | S2007 | B | → | ● | — | — | ▲ | — | ● | — | — | ▲ | — | ● | — | | | | | | | | | | | | | | | | |
| | | S2006 | B | ← | — | ● | — | — | ▲ | — | ● | — | — | ▲ | — | ● | ● | ● | ● | ● | ● | ● | — | — | ▲ | — | ● | — | — | ▲ | — | ● |
| | | S2005 | B | → | | | | | | | | | | | | | | | | | | — | ● | — | — | ▲ | — | ● | — | — | ▲ | — |
| | | S2004 | B | ← | | | | | | | | | | | | | | | | | | ▲ | — | ● | — | — | ▲ | — | ● | — | — | ▲ |
| | | S2003 | B | → | | | | | | | | | | | | | | | | | | — | ▲ | — | ● | — | — | ▲ | — | ● | — | — |
| | | S2002 | B | ← | | | | | | | | | | | | | | | | | | — | — | ▲ | — | ● | — | — | ▲ | — | ● | — |
| | | S2001 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C44 ~ C45 | S19 | S1910 | B | ← | ▲ | — | ● | — | — | ▲ | — | ● | — | — | | | | | | | | | | | | | | | | | | |
| | | S1909 | B | → | — | ▲ | — | ● | — | — | ▲ | — | ● | — | | | | | | | | | | | | | | | | | | |
| | | S1908 | B | ← | — | — | ▲ | — | ● | — | — | ▲ | — | ● | | | | | | | | | | | | | | | | | | |
| | | S1907 | B | → | ● | — | — | ▲ | — | ● | — | — | ▲ | — | | | | | | | | | | | | | | | | | | |
| | | S1906 | B | ← | — | ● | — | — | ▲ | — | ● | — | — | ▲ | ● | ● | ● | ● | ● | ● | — | ● | — | — | ▲ | — | ● | — | — | ▲ | — | ● |
| | | S1905 | B | → | | | | | | | | | | | | | | | | ▲ | — | ● | — | — | ▲ | — | ● | — | — | ▲ | — |
| | | S1904 | B | ← | | | | | | | | | | | | | | | | — | ▲ | — | ● | — | — | ▲ | — | ● | — | — | ▲ |
| | | S1903 | B | → | | | | | | | | | | | | | | | | — | — | ▲ | — | ● | — | — | ▲ | — | ● | — | — |
| | | S1902 | B | ← | | | | | | | | | | | | | | | | ● | — | — | ▲ | — | ● | — | — | ▲ | — | ● | — |
| | | S1901 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C42 ~ C43 | S18 | S1810 | B | ← | ▲ | — | ● | — | — | ▲ | — | ● | | | | | | | | | | | | | | | | | | | | |
| | | S1809 | B | → | — | ▲ | — | ● | — | — | ▲ | — | | | | | | | | | | | | | | | | | | | | |
| | | S1808 | B | ← | — | — | ▲ | — | ● | — | — | ▲ | | | | | | | | | | | | | | | | | | | | |
| | | S1807 | B | → | ● | — | — | ▲ | — | ● | — | — | | | | | | | | | | | | | | | | | | | | |
| | | S1806 | B | ← | — | ● | — | — | ▲ | — | ● | — | ● | ● | ● | ● | ● | ● | ● | ▲ | — | ● | — | — | ▲ | — | ● | — | — | ▲ | — | ● |
| | | S1805 | B | → | | | | | | | | | | | | | | | | — | ▲ | — | ● | — | — | ▲ | — | ● | — | — | ▲ | — |
| | | S1804 | B | ← | | | | | | | | | | | | | | | | — | — | ▲ | — | ● | — | — | ▲ | — | ● | — | — | ▲ |
| | | S1803 | B | → | | | | | | | | | | | | | | | | ● | — | — | ▲ | — | ● | — | — | ▲ | — | ● | — | — |
| | | S1802 | B | ← | | | | | | | | | | | | | | | | — | ● | — | — | ▲ | — | ● | — | — | ▲ | — | ● | — |
| | | S1801 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C40 ~ C41 | S17 | S1710 | B | ← | ▲ | — | ● | — | — | ▲ | | | | | | | | | | | | | | | | | | | | | | |
| | | S1709 | B | → | — | ▲ | — | ● | — | — | | | | | | | | | | | | | | | | | | | | | | |
| | | S1708 | B | ← | — | — | ▲ | — | ● | — | | | | | | | | | | | | | | | | | | | | | | |
| | | S1707 | B | → | ● | — | — | ▲ | — | ● | | | | | | | | | | | | | | | | | | | | | | |
| | | S1706 | B | ← | — | ● | — | — | ▲ | — | ● | ● | ● | ● | ● | ● | ● | ● | ● | ▲ | — | ● | — | — | ▲ | — | ● | — | — | ▲ | — | ● |
| | | S1705 | B | → | | | | | | | | | | | | | | | | — | ▲ | — | ● | — | — | ▲ | — | ● | — | — | ▲ | — |
| | | S1704 | B | ← | | | | | | | | | | | | | | | | — | — | ▲ | — | ● | — | — | ▲ | — | ● | — | — | ▲ |
| | | S1703 | B | → | | | | | | | | | | | | | | | | ● | — | — | ▲ | — | ● | — | — | ▲ | — | ● | — | — |
| | | S1702 | B | ← | | | | | | | | | | | | | | | | — | ● | — | — | ▲ | — | ● | — | — | ▲ | — | ● | — |
| | | S1701 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C36 ~ C39 | S16 | S1606 | B | ← | ● | ● | ● | ● | ● | ● | ● | ● | ● | ● | ● | ● | ● | ● | ● | ▲ | — | ● | — | — | ▲ | — | ● | — | — | ▲ | — | ● |
| | | S1605 | B | → | | | | | | | | | | | | | | | | — | ▲ | — | ● | — | — | ▲ | — | ● | — | — | ▲ | — |
| | | S1604 | B | ← | | | | | | | | | | | | | | | | — | — | ▲ | — | ● | — | — | ▲ | — | ● | — | — | ▲ |
| | | S1603 | B | → | | | | | | | | | | | | | | | | ● | — | — | ▲ | — | ● | — | — | ▲ | — | ● | — | — |
| | | S1602 | B | ← | | | | | | | | | | | | | | | | — | ● | — | — | ▲ | — | ● | — | — | ▲ | — | ● | — |
| | | S1601 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C34~ C35 | S15 | S1502 | B | ← | ● | ● | ● | ● | ● | ● | ● | ● | ● | ● | ● | ● | ● | ● | ● | ● | ● | ● | ● | ● | ● | ● | ● | ● | ● | ● | ● | ● |
| | | S1501 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | | | a | b | c | d | e | f | g | h | i | j | k | l | m | n | o | p | q | r | s | t | u | v | w | x | y | z | aa | ab |

10S

#1 Course
#2 Step
#3 Substep
#4 Needle bed
#5 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 5

| #1 | #2 | #3 | #4 | #5 | Knitting method | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| C56 | S25 | S2502 | B | ← | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● | ● |
| | | S2501 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C54 ~ C55 | S24 | S2410 | B | ← | ▲ | — | ● | — | — | ▲ | | | | | | | | | | | | | | | | | | | | | | | | | | | | | | | | |
| | | S2409 | B | → | — | ▲ | — | ● | — | — | | | | | | | | | | | | | | | | | | | | | | | | | | | | | | | | |
| | | S2408 | B | ← | — | — | ▲ | — | ● | — | | | | | | | | | | | | | | | | | | | | | | | | | | | | | | | | |
| | | S2407 | B | → | ● | — | — | ▲ | — | ● | | | | | | | | | | | | | | | | | | | | | | | | | | | | | | | | |
| | | S2406 | B | ← | — | ● | — | — | ▲ | — | ● | ● | ● | ● | ● | ● | ● | ● | ● | ● | ● | ● | ● | ● | ● | ● | ● | — | ● | — | | | | | | | | | | | | |
| | | S2405 | B | → | | | | | | | | | | | | | | | | | | | | | | | | ▲ | — | ● | | | | | | | | | | | | |
| | | S2404 | B | ← | | | | | | | | | | | | | | | | | | | | | | | | — | ▲ | — | | | | | | | | | | | | |
| | | S2403 | B | → | | | | | | | | | | | | | | | | | | | | | | | | — | — | ▲ | | | | | | | | | | | | |
| | | S2402 | B | ← | | | | | | | | | | | | | | | | | | | | | | | | ● | — | — | ● | ● | ● | ● | | | | | | | | |
| | | S2401 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C52 ~ C53 | S23 | S2310 | B | ← | ▲ | — | ● | — | — | ▲ | — | ● | | | | | | | | | | | | | | | | | | | | | | | | | | | | | | |
| | | S2309 | B | → | — | ▲ | — | ● | — | — | ▲ | — | | | | | | | | | | | | | | | | | | | | | | | | | | | | | | |
| | | S2308 | B | ← | — | — | ▲ | — | ● | — | — | ▲ | | | | | | | | | | | | | | | | | | | | | | | | | | | | | | |
| | | S2307 | B | → | ● | — | — | ▲ | — | ● | — | — | | | | | | | | | | | | | | | | | | | | | | | | | | | | | | |
| | | S2306 | B | ← | — | ● | — | — | ▲ | — | ● | — | ● | ● | ● | ● | ● | ● | ● | ● | ● | ● | ● | ● | ▲ | — | ● | — | — | | | | | | | | | | | | | |
| | | S2305 | B | → | | | | | | | | | | | | | | | | | | | | | — | ▲ | — | ● | — | | | | | | | | | | | | | |
| | | S2304 | B | ← | | | | | | | | | | | | | | | | | | | | | — | — | ▲ | — | ● | | | | | | | | | | | | | |
| | | S2303 | B | → | | | | | | | | | | | | | | | | | | | | | ● | — | — | ▲ | — | | | | | | | | | | | | | |
| | | S2302 | B | ← | | | | | | | | | | | | | | | | | | | | | — | ● | — | — | ▲ | ● | ● | ● | | | | | | | | | | |
| | | S2301 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C50 ~ C51 | S22 | S2210 | B | ← | ▲ | — | ● | — | — | ▲ | — | ● | — | — | | | | | | | | | | | | | | | | | | | | | | | | | | | | |
| | | S2209 | B | → | — | ▲ | — | ● | — | — | ▲ | — | ● | — | | | | | | | | | | | | | | | | | | | | | | | | | | | | |
| | | S2208 | B | ← | — | — | ▲ | — | ● | — | — | ▲ | — | ● | | | | | | | | | | | | | | | | | | | | | | | | | | | | |
| | | S2207 | B | → | ● | — | — | ▲ | — | ● | — | — | ▲ | — | | | | | | | | | | | | | | | | | | | | | | | | | | | | |
| | | S2206 | B | ← | — | ● | — | — | ▲ | — | ● | — | — | ▲ | ● | ● | ● | ● | ● | ● | ● | ● | ● | — | ▲ | — | ● | — | — | ▲ | | | | | | | | | | | | |
| | | S2205 | B | → | | | | | | | | | | | | | | | | | | | | | — | — | ▲ | — | ● | — | — | | | | | | | | | | | |
| | | S2204 | B | ← | | | | | | | | | | | | | | | | | | | | | ● | — | — | ▲ | — | ● | — | | | | | | | | | | | |
| | | S2203 | B | → | | | | | | | | | | | | | | | | | | | | | — | ● | — | — | ▲ | — | ● | | | | | | | | | | | |
| | | S2202 | B | ← | | | | | | | | | | | | | | | | | | | | | ▲ | — | ● | — | — | ▲ | — | ● | ● | | | | | | | | | |
| | | S2201 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| C48 ~ C49 | S21 | S2110 | B | ← | ▲ | — | ● | — | — | ▲ | — | ● | — | — | ▲ | — | | | | | | | | | | | | | | | | | | | | | | | | | | |
| | | S2109 | B | → | — | ▲ | — | ● | — | — | ▲ | — | ● | — | — | ▲ | | | | | | | | | | | | | | | | | | | | | | | | | | |
| | | S2108 | B | ← | — | — | ▲ | — | ● | — | — | ▲ | — | ● | — | — | | | | | | | | | | | | | | | | | | | | | | | | | | |
| | | S2107 | B | → | ● | — | — | ▲ | — | ● | — | — | ▲ | — | ● | — | | | | | | | | | | | | | | | | | | | | | | | | | | |
| | | S2106 | B | ← | — | ● | — | — | ▲ | — | ● | — | — | ▲ | — | ● | ● | ● | ● | ● | ● | ● | — | — | ▲ | — | ● | — | — | ▲ | — | | | | | | | | | | | |
| | | S2105 | B | → | | | | | | | | | | | | | | | | | | | ● | — | — | ▲ | — | ● | — | — | ▲ | | | | | | | | | | | |
| | | S2104 | B | ← | | | | | | | | | | | | | | | | | | | — | ● | — | — | ▲ | — | ● | — | — | | | | | | | | | | | |
| | | S2103 | B | → | | | | | | | | | | | | | | | | | | | ▲ | — | ● | — | — | ▲ | — | ● | — | | | | | | | | | | | |
| | | S2102 | B | ← | | | | | | | | | | | | | | | | | | | — | ▲ | — | ● | — | — | ▲ | — | ● | ● | | | | | | | | | | |
| | | S2101 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | | | a | b | c | d | e | f | g | h | i | j | k | l | m | n | o | p | q | r | s | t | u | v | w | x | y | z | aa | ab | | | | | | | | | | |

10S

#1 Course
#2 Step
#3 Substep
#4 Needle bed
#5 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 9

| #1 | #2 | #3 | #4 | #5 | Knitting method | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|
| C209 | S27 | S2705 | B | ← | — | ▲ | — | ● | — | — | ▲ | — | ● | — | — | ▲ | — | ● | — | — | ▲ | — | ● | — | — | ▲ | — | ● | — | — | ▲ | — |
| | | S2704 | B | → | — | — | ▲ | — | ● | — | — | ▲ | — | ● | — | — | ▲ | — | ● | — | — | ▲ | — | ● | — | — | ▲ | — | ● | — | — | ▲ |
| | | S2703 | B | ← | ● | — | — | ▲ | — | ● | — | — | ▲ | — | ● | — | — | ▲ | — | ● | — | — | ▲ | — | ● | — | — | ▲ | — | ● | — | — |
| | | S2702 | B | → | — | ● | — | — | ▲ | — | ● | — | — | ▲ | — | ● | — | — | ▲ | — | ● | — | — | ▲ | — | ● | — | — | ▲ | — | ● | — |
| | | S2701 | B | ← | ▲ | — | ● | — | — | ▲ | — | ● | — | — | ▲ | — | ● | — | — | ▲ | — | ● | — | — | ▲ | — | ● | — | — | ▲ | — | ● |
| C208 | S26 | S2640 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | S2639 | B | ← | — | ▲ | — | ● | — | — | ▲ | — | ● | — | — | ▲ | — | ● | — | — | ▲ | — | ● | — | ▲ | | | | | | | |
| | | S2638 | B | → | | | | | | | ▲ | — | — | ● | — | — | ▲ | — | ● | — | — | ▲ | — | ● | — | | | | | | | |
| | | S2637 | B | ← | | | | | | | — | — | ▲ | — | ● | — | — | ▲ | — | ● | — | — | ▲ | — | ● | ▲ | | | | | | |
| | | S2636 | B | → | | | | | | | | ▲ | — | ▲ | — | ● | — | — | ▲ | — | ● | — | — | ▲ | — | ● | | | | | | |
| C207 | | S2635 | B | ← | | | | | | | | ● | — | — | ▲ | — | ● | — | — | ▲ | — | ● | — | — | ▲ | | | | | | | |
| | | S2634 | B | → | | | | | | | ▲ | — | ● | — | — | ▲ | — | ● | — | — | ▲ | — | ● | — | — | | | | | | | |
| | | S2633 | B | ← | | | | | | | — | ▲ | — | ● | — | — | ▲ | — | ● | — | — | ▲ | — | ● | — | ▲ | | | | | | |
| | | S2632 | B | → | | | | | | ▲ | — | — | ▲ | — | ● | — | — | ▲ | — | ● | — | — | ▲ | — | ● | — | | | | | | |
| | | S2631 | B | ← | | | | | | — | ● | — | — | ▲ | — | ● | — | — | ▲ | — | ● | — | — | ▲ | — | ● | ▲ | | | | | |
| C206 | | S2630 | B | → | | | | | | | ▲ | ● | — | — | ▲ | — | ● | — | — | ▲ | — | ● | — | — | ▲ | — | ● | | | | | |
| | | S2629 | B | ← | | | | | | | — | — | ● | — | — | ▲ | — | ● | — | — | ▲ | — | ● | — | — | ▲ | | | | | | |
| | | S2628 | B | → | | | | | | ▲ | — | ▲ | — | ● | — | — | ▲ | — | ● | — | — | ▲ | — | ● | — | — | | | | | | |
| | | S2627 | B | ← | | | | | | ● | — | — | ▲ | — | ● | — | — | ▲ | — | ● | — | — | ▲ | — | ● | — | ▲ | | | | | |
| | | S2626 | B | → | | | | | ▲ | — | ● | — | — | ▲ | — | ● | — | — | ▲ | — | ● | — | — | ▲ | — | ● | — | | | | | |
| C205 | | S2625 | B | ← | | | | | — | — | — | ● | — | — | ▲ | — | ● | — | — | ▲ | — | ● | — | — | ▲ | — | ● | ▲ | | | | |
| | | S2624 | B | → | | | | | | ▲ | — | — | ● | — | — | ▲ | — | ● | — | — | ▲ | — | ● | — | — | ▲ | — | ● | | | | |
| | | S2623 | B | ← | | | | | | — | — | ▲ | — | ● | — | — | ▲ | — | ● | — | — | ▲ | — | ● | — | — | ▲ | | | | | |
| | | S2622 | B | → | | | | | ▲ | ● | — | — | ▲ | — | ● | — | — | ▲ | — | ● | — | — | ▲ | — | ● | — | — | | | | | |
| | | S2621 | B | ← | | | | | — | — | ● | — | — | ▲ | — | ● | — | — | ▲ | — | ● | — | — | ▲ | — | ● | — | ▲ | | | | |
| C204 | | S2620 | B | → | | | | ▲ | — | ▲ | — | ● | — | — | ▲ | — | ● | — | — | ▲ | — | ● | — | — | ▲ | — | ● | — | | | | |
| | | S2619 | B | ← | | | | ● | — | — | ▲ | — | ● | — | — | ▲ | — | ● | — | — | ▲ | — | ● | — | — | ▲ | — | ● | ▲ | | | |
| | | S2618 | B | → | | | | | ▲ | — | — | ▲ | — | ● | — | — | ▲ | — | ● | — | — | ▲ | — | ● | — | — | ▲ | — | ● | | | |
| | | S2617 | B | ← | | | | | — | ● | — | — | ▲ | — | ● | — | — | ▲ | — | ● | — | — | ▲ | — | ● | — | — | ▲ | | | | |
| | | S2616 | B | → | | | | ▲ | — | — | ● | — | — | ▲ | — | ● | — | — | ▲ | — | ● | — | — | ▲ | — | ● | — | — | | | | |
| C203 | | S2615 | B | ← | | | | — | — | ▲ | — | ● | — | — | ▲ | — | ● | — | — | ▲ | — | ● | — | — | ▲ | — | ● | — | ▲ | | | |
| | | S2614 | B | → | | | ▲ | ● | — | — | ▲ | — | ● | — | — | ▲ | — | ● | — | — | ▲ | — | ● | — | — | ▲ | — | ● | — | | | |
| | | S2613 | B | ← | | | — | — | ● | — | — | ▲ | — | ● | — | — | ▲ | — | ● | — | — | ▲ | — | ● | — | — | ▲ | — | ● | ▲ | | |
| | | S2612 | B | → | | | | ▲ | — | ● | — | — | ▲ | — | ● | — | — | ▲ | — | ● | — | — | ▲ | — | ● | — | — | ▲ | — | ● | | |
| | | S2611 | B | ← | | | | — | ▲ | — | ● | — | — | ▲ | — | ● | — | — | ▲ | — | ● | — | — | ▲ | — | ● | — | — | ▲ | | | |
| C202 | | S2610 | B | → | | | ▲ | — | — | ▲ | — | ● | — | — | ▲ | — | ● | — | — | ▲ | — | ● | — | — | ▲ | — | ● | — | — | | | |
| | | S2609 | B | ← | | | — | ● | — | — | ▲ | — | ● | — | — | ▲ | — | ● | — | — | ▲ | — | ● | — | — | ▲ | — | ● | — | ▲ | | |
| | | S2608 | B | → | | ▲ | — | — | ● | — | — | ▲ | — | ● | — | — | ▲ | — | ● | — | — | ▲ | — | ● | — | — | ▲ | — | ● | — | | |
| | | S2607 | B | ← | | — | — | ▲ | — | ● | — | — | ▲ | — | ● | — | — | ▲ | — | ● | — | — | ▲ | — | ● | — | — | ▲ | — | ● | ▲ | |
| | | S2606 | B | → | | | ▲ | — | ▲ | — | ● | — | — | ▲ | — | ● | — | — | ▲ | — | ● | — | — | ▲ | — | ● | — | — | ▲ | — | ● | |
| C201 | | S2605 | B | ← | | | ● | — | — | ▲ | — | ● | — | — | ▲ | — | ● | — | — | ▲ | — | ● | — | — | ▲ | — | ● | — | — | ▲ | | |
| | | S2604 | B | → | | ▲ | — | ● | — | — | ▲ | — | ● | — | — | ▲ | — | ● | — | — | ▲ | — | ● | — | — | ▲ | — | ● | — | — | | |
| | | S2603 | B | ← | | — | ▲ | — | ● | — | — | ▲ | — | ● | — | — | ▲ | — | ● | — | — | ▲ | — | ● | — | — | ▲ | — | ● | — | ▲ | |
| | | S2602 | B | → | ▲ | — | — | ▲ | — | ● | — | — | ▲ | — | ● | — | — | ▲ | — | ● | — | — | ▲ | — | ● | — | — | ▲ | — | ● | — | |
| | | S2601 | B | ← | — | ● | — | — | ▲ | — | ● | — | — | ▲ | — | ● | — | — | ▲ | — | ● | — | — | ▲ | — | ● | — | — | ▲ | — | ● | ▲ |
| Knitting needle | | | | | a | b | c | d | e | f | g | h | i | j | k | l | m | n | o | p | q | r | s | t | u | v | w | x | y | z | aa | ab |

10S

#1 Course
#2 Step
#3 Substep
#4 Needle bed
#5 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 10

| #1 | #2 | #3 | #4 | #5 | Knitting method | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|
| C220 | S30 | S3002 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| | | S3001 | B | ← | — | ● | ● | — | — | ● | ● | — | — | ● | ● | — | — | ● | ● | — | — | ● | ● | — | — | ● | ● | — | — | ● | ● | — | — | ● | ● | ▲ | | | | | |
| C219 | S29 | S2915 | B | → | ▲ | — | — | ● | ● | — | — | ● | ● | — | — | ● | ● | — | — | ● | ● | — | — | ● | ● | — | — | ● | ● | — | — | ● | | | | | | | | | |
| | | S2914 | B | ← | — | ● | ● | — | — | ● | ● | — | — | ● | ● | — | — | ● | ● | — | — | ● | ● | — | — | ● | ● | — | — | ● | ▲ | | | | | | | | | | |
| | | S2913 | B | → | | ▲ | — | ● | ● | — | — | ● | ● | — | — | ● | ● | — | — | ● | ● | — | — | ● | ● | — | — | ● | ● | — | — | | | | | | | | | | |
| | | S2912 | B | ← | | ● | ● | — | — | ● | ● | — | — | ● | ● | — | — | ● | ● | — | — | ● | ● | — | — | ● | ● | — | — | ▲ | | | | | | | | | | | |
| | | S2911 | B | → | | | ▲ | ● | ● | — | — | ● | ● | — | — | ● | ● | — | — | ● | ● | — | — | ● | ● | — | — | ● | ● | — | | | | | | | | | | | |
| C218 | | S2910 | B | ← | | | ● | — | — | ● | ● | — | — | ● | ● | — | — | ● | ● | — | — | ● | ● | — | — | ● | ● | — | — | ▲ | | | | | | | | | | | |
| | | S2909 | B | → | | | | ▲ | ● | — | — | ● | ● | — | — | ● | ● | — | — | ● | ● | — | — | ● | ● | — | — | ● | ● | — | | | | | | | | | | | |
| | | S2908 | B | ← | | | | — | — | ● | ● | — | — | ● | ● | — | — | ● | ● | — | — | ● | ● | — | — | ● | ● | — | ▲ | | | | | | | | | | | | |
| | | S2907 | B | → | | | | | ▲ | — | — | ● | ● | — | — | ● | ● | — | — | ● | ● | — | — | ● | ● | — | — | ● | ● | | | | | | | | | | | | |
| | | S2906 | B | ← | | | | | — | ● | ● | — | — | ● | ● | — | — | ● | ● | — | — | ● | ● | — | — | ● | ● | ▲ | | | | | | | | | | | | | |
| C217 | | S2905 | B | → | | | | | | ▲ | — | ● | ● | — | — | ● | ● | — | — | ● | ● | — | — | ● | ● | — | — | ● | | | | | | | | | | | | | |
| | | S2904 | B | ← | | | | | | ● | ● | — | — | ● | ● | — | — | ● | ● | — | — | ● | ● | — | — | ● | ▲ | | | | | | | | | | | | | |
| | | S2903 | B | → | | | | | | | ▲ | ● | ● | — | — | ● | ● | — | — | ● | ● | — | — | ● | ● | — | — | | | | | | | | | | | | | | |
| | | S2902 | B | ← | | | | | | | — | — | — | ● | ● | — | — | ● | ● | — | — | ● | ● | — | — | ▲ | | | | | | | | | | | | | | | |
| | | S2901 | B | → | | | | | | | | ▲ | ● | — | — | ● | ● | — | — | ● | ● | — | — | ● | ● | — | | | | | | | | | | | | | | | |
| C216 | S28 | S2836 | B | ← | | | | | | | | — | ● | — | — | ▲ | — | ● | — | — | ▲ | — | ● | — | ▲ | | | | | | | | | | | | | | | |
| | | S2835 | B | → | | | | | | | ▲ | — | — | ● | — | — | ▲ | — | ● | — | — | ▲ | — | ● | — | | | | | | | | | | | | | | | | |
| | | S2834 | B | ← | | | | | | | — | — | ▲ | — | ● | — | — | ▲ | — | ● | — | — | ▲ | — | ● | ▲ | | | | | | | | | | | | | | | |
| | | S2833 | B | → | | | | | | ▲ | ● | — | — | ▲ | — | ● | — | — | ▲ | — | ● | — | — | ▲ | — | ● | | | | | | | | | | | | | | | |
| | | S2832 | B | ← | | | | | | — | — | ● | — | — | ▲ | — | ● | — | — | ▲ | — | ● | — | — | ▲ | — | ▲ | | | | | | | | | | | | | | |
| C215 | | S2831 | B | → | | | | | | | ▲ | — | ● | — | — | ▲ | — | ● | — | — | ▲ | — | ● | — | — | ▲ | — | | | | | | | | | | | | | | |
| | | S2830 | B | ← | | | | | | | — | ▲ | — | ● | — | — | ▲ | — | ● | — | — | ▲ | — | ● | — | ▲ | | | | | | | | | | | | | | | |
| | | S2829 | B | → | | | | | | ▲ | — | — | ▲ | — | ● | — | — | ▲ | — | ● | — | — | ▲ | — | ● | — | | | | | | | | | | | | | | | |
| | | S2828 | B | ← | | | | | | — | ● | — | — | ▲ | — | ● | — | — | ▲ | — | ● | — | — | ▲ | — | ● | ▲ | | | | | | | | | | | | | | |
| | | S2827 | B | → | | | | | ▲ | — | — | ● | — | — | ▲ | — | ● | — | — | ▲ | — | ● | — | — | ▲ | — | ● | | | | | | | | | | | | | | |
| C214 | | S2826 | B | ← | | | | | — | — | ▲ | — | ● | — | — | ▲ | — | ● | — | — | ▲ | — | ● | — | — | ▲ | — | ▲ | | | | | | | | | | | | | |
| | | S2825 | B | → | | | | | | ▲ | — | ▲ | — | ● | — | — | ▲ | — | ● | — | — | ▲ | — | ● | — | — | ▲ | — | | | | | | | | | | | | | |
| | | S2824 | B | ← | | | | | | ● | — | — | ▲ | — | ● | — | — | ▲ | — | ● | — | — | ▲ | — | ● | — | ▲ | | | | | | | | | | | | | | |
| | | S2823 | B | → | | | | | ▲ | — | ● | — | — | ▲ | — | ● | — | — | ▲ | — | ● | — | — | ▲ | — | ● | — | | | | | | | | | | | | | | |
| | | S2822 | B | ← | | | | | — | ▲ | — | ● | — | — | ▲ | — | ● | — | — | ▲ | — | ● | — | — | ▲ | — | ● | ▲ | | | | | | | | | | | | | |
| C213 | | S2821 | B | → | | | | ▲ | — | — | ▲ | — | ● | — | — | ▲ | — | ● | — | — | ▲ | — | ● | — | — | ▲ | — | ● | | | | | | | | | | | | | |
| | | S2820 | B | ← | | | | — | ● | — | — | ▲ | — | ● | — | — | ▲ | — | ● | — | — | ▲ | — | ● | — | — | ▲ | — | ▲ | | | | | | | | | | | | |
| | | S2819 | B | → | | | | | ▲ | ● | — | — | ▲ | — | ● | — | — | ▲ | — | ● | — | — | ▲ | — | ● | — | — | ▲ | — | | | | | | | | | | | | |
| | | S2818 | B | ← | | | | | | — | — | ● | — | — | ▲ | — | ● | — | — | ▲ | — | ● | — | — | ▲ | — | ● | — | ▲ | | | | | | | | | | | | |
| | | S2817 | B | → | | | | ▲ | — | ▲ | — | ● | — | — | ▲ | — | ● | — | — | ▲ | — | ● | — | — | ▲ | — | ● | — | | | | | | | | | | | | | |
| C212 | | S2816 | B | ← | | | | ● | — | — | ▲ | — | ● | — | — | ▲ | — | ● | — | — | ▲ | — | ● | — | — | ▲ | — | ● | ▲ | | | | | | | | | | | | |
| | | S2815 | B | → | | | ▲ | — | ● | — | — | ▲ | — | ● | — | — | ▲ | — | ● | — | — | ▲ | — | ● | — | — | ▲ | — | ● | | | | | | | | | | | | |
| | | S2814 | B | ← | | | — | — | — | ● | — | — | ▲ | — | ● | — | — | ▲ | — | ● | — | — | ▲ | — | ● | — | — | ▲ | — | ▲ | | | | | | | | | | | |
| | | S2813 | B | → | | | | ▲ | — | — | ● | — | — | ▲ | — | ● | — | — | ▲ | — | ● | — | — | ▲ | — | ● | — | — | ▲ | — | | | | | | | | | | | |
| | | S2812 | B | ← | | | | — | — | ▲ | — | ● | — | — | ▲ | — | ● | — | — | ▲ | — | ● | — | — | ▲ | — | ● | — | ▲ | | | | | | | | | | | | |
| C211 | | S2811 | B | → | | | ▲ | ● | — | — | ▲ | — | ● | — | — | ▲ | — | ● | — | — | ▲ | — | ● | — | — | ▲ | — | ● | — | | | | | | | | | | | | |
| | | S2810 | B | ← | | | — | — | ● | — | — | ▲ | — | ● | — | — | ▲ | — | ● | — | — | ▲ | — | ● | — | — | ▲ | — | ● | ▲ | | | | | | | | | | | |
| | | S2809 | B | → | | ▲ | — | ▲ | — | ● | — | — | ▲ | — | ● | — | — | ▲ | — | ● | — | — | ▲ | — | ● | — | — | ▲ | — | ● | | | | | | | | | | | |
| | | S2808 | B | ← | | — | — | — | ▲ | — | ● | — | — | ▲ | — | ● | — | — | ▲ | — | ● | — | — | ▲ | — | ● | — | — | ▲ | — | ▲ | | | | | | | | | | |
| | | S2807 | B | → | | | ▲ | — | — | ▲ | — | ● | — | — | ▲ | — | ● | — | — | ▲ | — | ● | — | — | ▲ | — | ● | — | — | ▲ | — | | | | | | | | | | |
| C210 | | S2806 | B | ← | | | — | ● | — | — | ▲ | — | ● | — | — | ▲ | — | ● | — | — | ▲ | — | ● | — | — | ▲ | — | ● | — | ▲ | | | | | | | | | | | |
| | | S2805 | B | → | | ▲ | — | — | ● | — | — | ▲ | — | ● | — | — | ▲ | — | ● | — | — | ▲ | — | ● | — | — | ▲ | — | ● | — | | | | | | | | | | | |
| | | S2804 | B | ← | | — | — | ▲ | — | ● | — | — | ▲ | — | ● | — | — | ▲ | — | ● | — | — | ▲ | — | ● | — | — | ▲ | — | ● | ▲ | | | | | | | | | | |
| | | S2803 | B | → | ▲ | — | ▲ | — | ▲ | — | ● | — | — | ▲ | — | ● | — | — | ▲ | — | ● | — | — | ▲ | — | ● | — | — | ▲ | — | ● | | | | | | | | | | |
| | | S2802 | B | ← | — | — | ● | — | — | ▲ | — | ● | — | — | ▲ | — | ● | — | — | ▲ | — | ● | — | — | ▲ | — | ● | — | — | ▲ | — | ▲ | | | | | | | | | |
| | | S2801 | F | → | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | | | a | b | c | d | e | f | g | h | i | j | k | l | m | n | o | p | q | r | s | t | u | v | w | x | y | z | aa | ab | | | | | | | | |

#1 Course
#2 Step
#3 Substep
#4 Needle bed
#5 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

10S

FIG. 11

| #1 | #2 | #3 | Knitting method | | | | | | | | | | | | | | | | | | | |
|---|---|---|---|---|---|---|---|---|---|---|---|---|---|---|---|---|---|---|---|---|---|---|
| S3108 | B | ← | ● | ● | ● | ● | ● | ● | ● | — | — | — | ▲ | — | — | | | | | | | |
| S3107 | B | → | | | | | | | — | — | ● | — | — | ▲ | — | | | | | | | |
| S3106 | B | ← | | | | | | | — | ● | ● | — | — | — | ▲ | | | | | | | |
| S3105 | B | → | | | | | | | ▲ | — | — | — | ● | — | — | | | | | | | |
| S3104 | B | ← | | | | | | | — | ▲ | — | ● | — | — | — | | | | | | | |
| S3103 | B | → | | | | | | | — | — | — | ▲ | — | ● | — | | | | | | | |
| S3102 | B | ← | | | | | | | — | — | ▲ | — | — | — | ● | ● | ● | ● | ● | ● | ● | ● |
| S3101 | F | → | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | a | b | c | d | e | f | g | h | i | j | k | l | m | n | o | p | q | r | s | t |

30S

#1 Substep
#2 Needle bed
#3 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 12

| #1 | #2 | #3 | Knitting method | | | | | | | | | | | | | | | | | | | |
|---|---|---|---|---|---|---|---|---|---|---|---|---|---|---|---|---|---|---|---|---|---|---|
| S4016 | B | ← | ● | ● | ● | ● | ● | ● | ● | — | ▲ | — | — | — | ▲ | | | | | | | |
| S4015 | B | → | | | | | | | — | ● | — | — | — | ▲ | — | | | | | | | |
| S4014 | B | ← | | | | | | | — | — | ● | — | ▲ | — | — | | | | | | | |
| S4013 | B | → | | | | | | | ▲ | — | — | — | ● | — | — | | | | | | | |
| S4012 | B | ← | | | | | | | — | ▲ | — | ● | — | — | — | | | | | | | |
| S4011 | B | → | | | | | | | — | — | — | ▲ | — | ● | — | | | | | | | |
| S4010 | B | ← | | | | | | | — | — | ▲ | — | — | — | ● | ● | ● | ● | ● | ● | ● | ● |
| S4009 | F | → | ○ | ○ | ○ | ○ | ○ | ○ | ○ | ○ | ○ | ○ | ○ | ○ | ○ | ○ | ○ | ○ | ○ | ○ | ○ | ○ |
| S4008 | B | ← | ● | ● | ● | ● | ● | ● | ● | — | ▲ | — | — | — | ▲ | | | | | | | |
| S4007 | B | → | | | | | | | — | ● | — | — | — | ▲ | — | | | | | | | |
| S4006 | B | ← | | | | | | | — | — | ● | — | ▲ | — | — | | | | | | | |
| S4005 | B | → | | | | | | | ▲ | — | — | — | ● | — | — | | | | | | | |
| S4004 | B | ← | | | | | | | — | ▲ | — | ● | — | — | — | | | | | | | |
| S4003 | B | → | | | | | | | — | — | — | ▲ | — | ● | — | | | | | | | |
| S4002 | B | ← | | | | | | | — | — | ▲ | — | — | — | ● | ● | ● | ● | ● | ● | ● | ● |
| S4001 | F | → | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | a | b | c | d | e | f | g | h | i | j | k | l | m | n | o | p | q | r | s | t |

40S

#1 Substep
#2 Needle bed
#3 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 13

| #1 | #2 | #3 | Knitting method | | | | | | | | | | | | | | | | | | | |
|---|---|---|---|---|---|---|---|---|---|---|---|---|---|---|---|---|---|---|---|---|---|---|
| S5008 | B | ← | ● | ● | ● | ● | ● | ● | ● | — | — | — | ▲ | — | — | | | | | | | |
| S5007 | B | → | | | | | | | — | ● | — | — | — | ▲ | — | | | | | | | |
| S5006 | B | ← | | | | | | | — | — | ● | — | — | — | ▲ | | | | | | | |
| S5005 | B | → | | | | | | | ▲ | — | — | — | ● | — | — | | | | | | | |
| S5004 | B | ← | | | | | | | — | ▲ | — | ● | — | — | — | | | | | | | |
| S5003 | B | → | | | | | | | — | — | — | ▲ | — | ● | — | | | | | | | |
| S5002 | B | ← | | | | | | | — | — | ▲ | — | — | — | ● | ● | ● | ● | ● | ● | ● | ● |
| S5001 | F | → | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | a | b | c | d | e | f | g | h | i | j | k | l | m | n | o | p | q | r | s | t |

50S

#1 Substep
#2 Needle bed
#3 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 14

| #1 | #2 | #3 | Knitting method | | | | | | | | | | | | | | | | | | | |
|---|---|---|---|---|---|---|---|---|---|---|---|---|---|---|---|---|---|---|---|---|---|---|
| S6008 | B | ← | ● | ● | ● | ● | ● | ● | ● | — | — | — | ▲ | — | — | | | | | | | |
| S6007 | B | → | | | | | | | — | ● | — | — | — | ▲ | — | | | | | | | |
| S6006 | B | ← | | | | | | | — | — | ● | — | — | — | ▲ | | | | | | | |
| S6005 | B | → | | | | | | | ▲ | — | — | ● | — | — | — | | | | | | | |
| S6004 | B | ← | | | | | | | — | ▲ | — | — | ● | — | — | | | | | | | |
| S6003 | B | → | | | | | | | — | — | — | ▲ | — | ● | — | | | | | | | |
| S6002 | B | ← | | | | | | | — | — | ▲ | — | — | — | ● | ● | ● | ● | ● | ● | ● | ● |
| S6001 | F | → | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | a | b | c | d | e | f | g | h | i | j | k | l | m | n | o | p | q | r | s | t |

60S

#1 Substep
#2 Needle bed
#3 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

FIG. 15

| #1 | #2 | #3 | Knitting method | | | | | | | | | | | | | | | | | | | |
|---|---|---|---|---|---|---|---|---|---|---|---|---|---|---|---|---|---|---|---|---|---|---|
| S7008 | B | ← | ● | ● | ● | ● | ● | ● | ● | — | — | — | ▲ | — | — | | | | | | | |
| S7007 | B | → | | | | | | | — | ● | — | — | — | ▲ | — | | | | | | | |
| S7006 | B | ← | | | | | | | — | — | ● | — | — | — | ▲ | | | | | | | |
| S7005 | B | → | | | | | | | ▲ | — | — | ● | — | — | — | | | | | | | |
| S7004 | B | ← | | | | | | | — | ▲ | — | — | ● | — | — | | | | | | | |
| S7003 | B | → | | | | | | | — | — | ▲ | — | — | ● | — | | | | | | | |
| S7002 | B | ← | | | | | | | — | — | — | ▲ | — | — | ● | ● | ● | ● | ● | ● | ● | ● |
| S7001 | F | → | ○ | ○ | ○ | ○ | ○ | ○ | ○ | ○ | ○ | ○ | ○ | ○ | ○ | ○ | ○ | ○ | ○ | ○ | ○ | ○ |
| Knitting needle | | | a | b | c | d | e | f | g | h | i | j | k | l | m | n | o | p | q | r | s | t |

70S

#1 Substep
#2 Needle bed
#3 Direction

F: Front-side needle bed
B: Rear-side needle bed
○: Knit stitch formation on front-side needle bed
△: Tuck stitch formation on front-side needle bed
●: Knit stitch formation on rear-side needle bed
▲: Tuck stitch formation on rear-side needle bed
—: Miss stitch (float stitch) formation

WEFT KNITTED FABRIC HAVING THICK PORTION AND KNITTING METHOD FOR THE SAME

BACKGROUND OF THE INVENTION

Field of the Invention

The present invention relates to weft knitted fabric having a thick portion in at least part of the weft knitted fabric in a course direction.

Description of the Related Art

Conventionally, as a method for forming a thick portion in knitted fabric formed into a weft texture, a method is known that tucks a ground weave in multiple layers using a connecting yarn and thereby connect the layers in a zigzag pattern (see Japanese Patent Publication No. 6-158483 and Japanese Patent Publication No. 2009-150007).

For example, Japanese Patent Publication No. 6-158483 proposes three-layer knitted fabric in which a ground weave formed by a cylinder-side loop of a circular knitting machine and a ground weave formed by a dial-side loop are tucked using a binding yarn and an elastic yarn is used for the ground weave to prevent snacking.

Also, Japanese Patent Publication No. 2009-150007 proposes multi-layer knitted fabric formed on flat knitting machine equipped with a pair of front and rear needle beds and configured such that three or more layers of a ground weave formed by transferring stitches between the front and rear needle beds are connected using a binding yarn, forming more layers than conventional three layers to acquire higher cushioning characteristics.

However, the knitting method described in Japanese Patent Publication No. 2009-150007 has a problem in that a large number of yarn carriers are needed in order to create enough layers to acquire sufficient cushioning characteristics, making it difficult to provide plural thick portions in a course direction.

SUMMARY OF THE INVENTION

The present invention has been made in view of the above problem and has an object to provide a knitting method for weft knitted fabric, the method allowing plural thick portions to be provided in a course direction as well as to provide weft knitted fabric having plural thick portions in the course direction.

The invention made to solve the above problem provides a knitting method for forming weft knitted fabric having a thick portion, the knitting method comprising a thick portion knitting step of forming at least one complete thick portion texture by continuously repeating a thick portion knitting substep n times (n is an integer equal to or larger than 5) while alternating yarn feeding directions, the thick portion knitting substep including feeding a knitting yarn once to a needle row made up of n knitting needles either (i) in one direction in which the needle row is arranged, or (ii) in another direction, wherein: the thick portion knitting substep performs knit stitch formation and tuck stitch formation on at least one of the knitting needles and performs miss stitch formation on at least n−3 or more knitting needles, and in forming one complete thick portion texture, the thick portion knitting step, performs knit stitch formation and tuck stitch formation at least once each and performs miss stitch formation n−3 or more times on each of the n knitting needles in the needle row.

In this way, with the knitting method according to the present invention, in forming one complete thick portion texture, the thick portion knitting substep of feeding a knitting yarn once to the needle row made up of n needles performs the knit stitch formation and the tuck stitch formation for at least one of the needles and performs the miss stitch formation on at least n−3 needles, and consequently the knit stitch formation is performed for only one or two needles out of the n needles in the needle row. In the thick portion knitting step of repeating the thick portion knitting substep n times while alternating the yarn feeding directions, since the knit stitch formation and the tuck stitch formation are performed at least once or twice or more and the miss stitch formation is performed at least n−3 times on each of the n knitting needles in the needle row, the knit stitch formation is performed only once or twice for each needle.

With this knitting method, in each complete thick portion texture, n double-loops are formed in a course direction and one double-loop or two double-loops arranged side by side are formed in a wale direction and at least 2n jump stitches are formed by miss stitch formation, each double-loop being made up of a tuck loop superposed on the back side of a knit loop and consequently a thick portion with a significant thickness can be formed.

With the knitting method according to the present invention, when the thick portion knitting step is finished once, because the knitting yarn can be fed using another needle row a few needles away from the needle row used for the thick portion knitting step and using the same yarn carrier as the one used for the thick portion knitting step, plural thick portions can be formed in a course direction by carrying out the thick portion knitting step repeatedly.

In the knitting method for weft knitted fabric having thick portions according to the present invention, preferably in forming the complete thick portion texture, the thick portion knitting substep is carried out zero times or once using three knitting needles in total for the knit stitch formation and the tuck stitch formation. Consequently, stitches in a texture of the thick portion can be made neat.

In the knitting method for weft knitted fabric having thick portions according to the present invention, preferably in forming the complete thick portion texture, the number of knitting needles used to perform the knit stitch formation and the tuck stitch formation three times in total is zero or one. Consequently, stitches in a texture of the thick portion can be made neater.

In the knitting method for weft knitted fabric having thick portions according to the present invention, preferably the knitting yarn is made up of face yarn, which is a non-elastic yarn, and a back yarn, which is an elastic yarn; and the knitting method comprises a reverse plating step of doing knitting using the non-elastic yarn as a back yarn and using the elastic yarn as a face yarn by reversing an order of a yarn carrier adapted to feed the face yarn and a yarn carrier adapted to feed the back yarn for at least some of the needles in the needle row between two preceding and following runs of the thick portion knitting step.

This makes it possible to provide a recess extending in the course direction in the thick portion.

In the knitting method for weft knitted fabric having thick portions according to the present invention, the thick portion knitting step may include a reduced-width portion knitting step of repeating the thick portion knitting substep multiple times by gradually reducing knitting needles targeted for yarn feeding, starting from opposite ends, and a gore line forming step of forming a pair of left and right gore lines by knitting loops kept hooked to knitting needles, the gore line forming step being carried out following the reduced-width portion knitting step.

When the thick portion knitting step is configured in this way, by applying the knitting method, for example, to heels of socks, thick portions can be formed in the heels of the socks having gore lines.

Preferably the thick portion knitting substep is repeated multiple times in the gore line forming step as well. This allows a thick portion to be formed on a rear side of the gore line as well.

The present invention also provides weft knitted fabric comprising a thick portion thicker than surroundings, wherein: the thick portion has a complete thick portion texture in one course of the weft knitted fabric, the complete thick portion texture being made up of n small courses (n is an integer equal to or larger than 5) and n wales, where the n small courses are formed by a knitting yarn making turns in a course direction; in the complete thick portion texture, each of the wales has one or two loops, and one of the loops in each of the wales is made up of a double-loop formed by superposing a knit loop and a tuck loop; and a combination of a small course in which the knit loop exists and a small course in which the tuck loop exists varies among the double-loops.

Note that the "double-loops" as referred to herein include triple- and higher multiple-loops.

As described above, the knitting method for weft knitted fabric having thick portions according to the present invention can form plural thick portions in the course direction of the weft knitted fabric.

BRIEF DESCRIPTION OF THE DRAWINGS

FIG. 2 is a knitting diagram of a ball-of-the-foot portion shown in FIG. 1;

FIG. 3 is a knitting diagram of the ball-of-the-foot portion continued from FIG. 2;

FIG. 4 is a knitting diagram of an inside-arch-of-the-foot portion and outside-arch-of-the-foot portion shown in FIG. 1;

FIG. 5 is a knitting diagram of the inside-arch-of-the-foot portion and outside-arch-of-the-foot portion continued from FIG. 4;

FIG. 9 is a knitting diagram of a front heel portion and front-side gore lines shown in FIG. 8;

FIG. 10 is a knitting diagram of a middle heel portion, rear-side gore lines, and a rear heel portion shown in FIG. 8;

FIG. 11 is a knitting diagram showing a knitting method for thick portions according to a third embodiment of the present invention;

FIG. 12 is a knitting diagram showing a knitting method for thick portions according to a fourth embodiment of the present invention;

FIG. 13 is a knitting diagram showing a knitting method for thick portions according to a fifth embodiment of the present invention;

FIG. 14 is a knitting diagram showing a knitting method for thick portions according to a sixth embodiment of the present invention;

FIG. 15 is a knitting diagram showing a knitting method for thick portions according to a seventh embodiment of the present invention;

DETAILED DESCRIPTION OF THE PREFERRED EMBODIMENTS

Embodiments of the present invention will be described in detail below with reference to the accompanying drawings as appropriate. In the following description, the toe side of weft knitted fabric having thick portions will be referred to as a front side and the heel side will be referred to as a rear side.

However, the present invention is not limited to the embodiment described below.

First Embodiment

Figure 1:
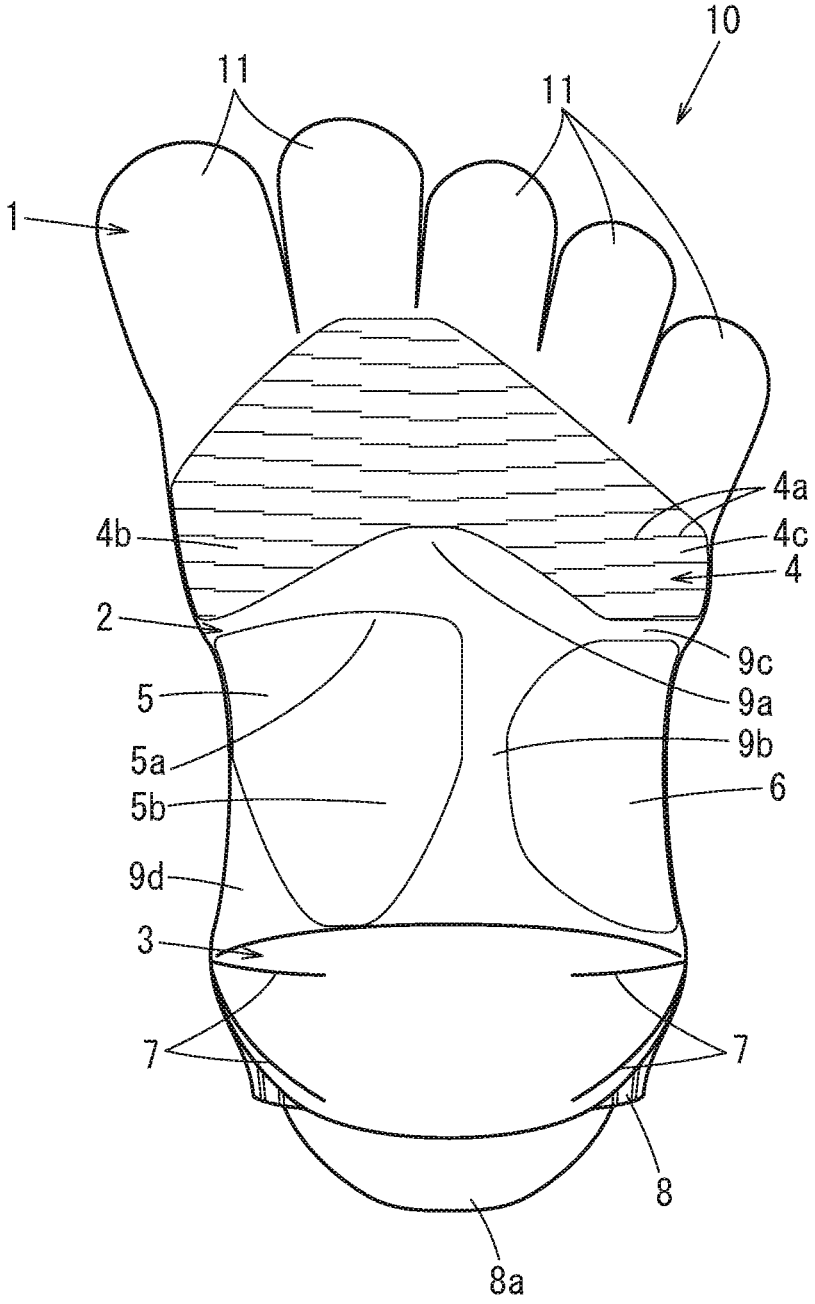
FIG. 1 is a bottom view of weft knitted fabric according to a first embodiment of the present invention, the knitted fabric having thick portions.

FIG. 1 shows a sock 10 made of weft knitted fabric according to a first embodiment of the present invention, the knitted fabric having thick portions. The sock 10 mainly includes a toe portion 1, a foot portion 2, a heel portion 3, and a cuff 8 as shown in FIG. 1 and is knitted by a flat knitting machine equipped with a pair of front and back needle beds F and B.

As a whole, the sock 10 is knitted by adding a face yarn to a back yarn. The face yarn is made of a cotton yarn. The back yarn is made of a single covering yarn (elastic yarn in the claims; hereinafter also referred to as an "SCY"), where the single covering yarn is formed by covering a core yarn made of a polyurethane yarn with a nylon yarn or the like, A double covering yarn (hereinafter also referred to as a "rubber yarn") is further inserted in the cuff 8, where the double covering yarn is formed by covering a core yarn with a nylon yarn, polyester yarn, and the like, the core yarn being made up of an urethane yarn. Needless to say, the face yarn and back yarn are not limited to this, and other publicly known yarns can be used as appropriate. Note that in the following description, the face yarn and back yarn taken together may be called a knitting yarn.

In the sock 10, the toe portion 1 has five separate toes 11 plain-knitted as shown in FIG. 1.

A foot portion 2 is made up of a part knitted after knitting of the toe portion 1, but knitted before knitting of the heel portion 3. As shown in FIG. 1, on the sole side, the foot portion 2 includes a ball-of-the-foot portion (thick portion) 4, an inside-arch-of-the-foot portion (thick portion) 5, an outside-arch-of-the-foot portion (thick portion) 6, a thin indented portion 9*a*, a thin longitudinal boundary portion 9*b*, a thin transverse boundary portion 9*c*, and a thin inside portion 9*d*.

As shown in FIG. 1, the ball-of-the-foot portion 4 has the shape of an inverted V with fork legs 4*b* and 4*c* on the heel side and includes plural transverse grooves 4*a* extending in a zigzag pattern in a foot width direction. The fork legs 4*b* and 4*c* are separated by the thin indented portion 9*a* in a circumferential direction (course direction) of the foot portion 2. The heel portion 3 portion includes two pairs of right and left gore lines 7 for a total of four. A tab 8*a* is attached to the cuff 8 to prevent the heel from hitting a heel collar of a shoe.

(Knitting Method)

FIGS. 2 to 5 are knitting diagrams schematically showing a knitting method of the foot portion 2 according to the first embodiment. In these knitting diagrams, a smaller number of needles are illustrated than there actually are, and in forming the knitted fabric according to the present invention, the number of needles can be changed as appropriate.

As shown in FIGS. 2 and 3, knitting of the foot portion 2 is done following the knitting of the separate toes 11. The ball-of-the-foot portion 4 made up of courses C1 to C24 is knitted in thick portion knitting steps S1 to S8. As shown in FIGS. 3 to 5, the inside-arch-of-the-foot portion 5 and the outside-arch-of-the-foot portion 6 made up of courses C25 to C55 are knitted in thick portion knitting steps S9 to S24.

(Thick Portion Knitting Step S1)

Thick portion knitting step (hereinafter also referred to simply as "step") S1 is carried out as follows. First, in thick portion knitting substep (hereinafter also referred to simply as "substep") S101, knit stitch formation (○) is performed to plain-knit the instep of the foot portion 2 by moving a carriage to the right while feeding a yarn to all needles from knitting needle a to knitting needle ab on a needle bed F on the front side. Next, in substep S102, the carriage is reversed and moved to the left, and knit stitch formation (●) is performed by feeding a yarn to all needles from knitting needle ab to knitting needle v on a needle bed B on the rear side. Then, in substeps S102 to S106, knitting is done by feeding the yarn to a needle row of 14 needles from knitting needle u to knitting needle h five times while alternating yarn feeding directions.

In substep S102, knitting is done as follows: of knitting needles u to h on the needle bed B on the rear side, tuck stitch formation (▲) is performed every five needles t, o, and j, knit stitch formation (●) is performed every five needles q and l, and miss stitch formation (-) is performed using the other knitting needles u, s, r, p, n, m, k, i, and h. Subsequently, substeps S103 to S106 are carried out by alternating the yarn feeding directions and by using knitting needles u to h on the needle bed B on the rear side as with substep S102: knit stitch formation (●) and tuck stitch formation (▲) are performed by shifting the knitting needles by one needle leftward from the previous substep on a substep by substep basis and miss stitch formation (-) is performed using the other knitting needles. In the last substep S106 of step S1, knit stitch formation (●) is performed using knitting needle h, and then knit stitch formation (●) is performed using knitting needles g to a.

In step S1, actions shown in the solid frame of FIG. 2 are used to knit a complete thick portion texture 10S, which is a basic texture of thick portions 4, 5, 6. The complete thick portion texture 10S corresponds to a case in which n=5 in the claims and is normally supposed to be knitted by performing knit stitch formation (●) once or twice, tuck stitch formation once or twice, and miss stitch formation (-) twice (2=5−3) or more in each substep. However, the complete thick portion texture 10S according to the first embodiment is knitted as follows: in substeps S102 to S106, in which knitting is done on the needle bed B on the rear side, while the yarn is fed five times to five needles, for example, from knitting needle 1 to knitting needle p (or from knitting needle q to knitting needle u), by changing the yarn feeding direction, knit stitch formation (●) is performed once, tuck stitch formation (▲) is performed once, and miss stitch formation (-) is performed three times in each substep, and thus knit stitch formation (●) is performed once, tuck stitch formation (▲) is performed once, and miss stitch formation (-) is performed three times per knitting needle.

That is, the thick portion knitting step S1 corresponds to that case in the claims in which while complete thick portion texture 10S is formed, the thick portion knitting substep is carried out zero times using three knitting needles in total for the knit stitch formation (●) and the tuck stitch formation (▲) and the number of knitting needles used to perform the knit stitch formation and the tuck stitch formation three times in total is zero.

Figure 6:
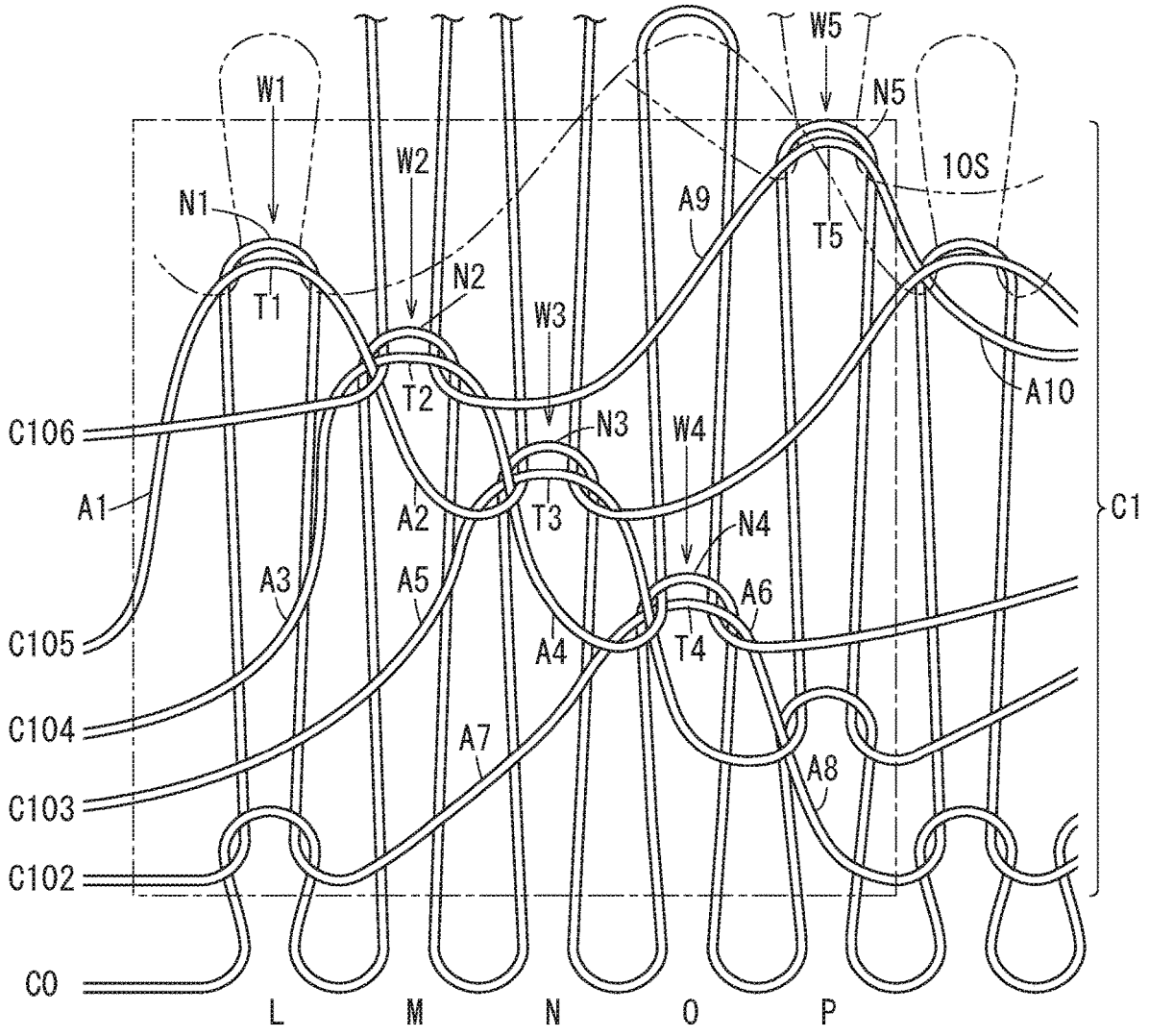
FIG. 6 is an organizational chart created by prolonging a complete thick portion texture knitted by a knitting method shown in a solid frame of FIG. 2, in a wale direction.
Figure 7:
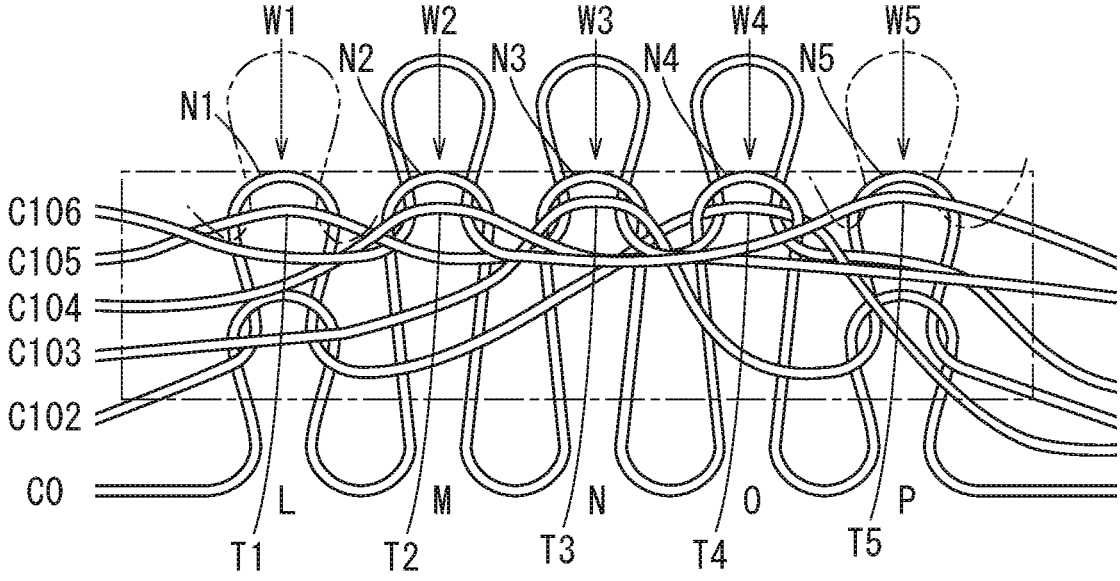
FIG. 7 is an organizational chart created by contracting the organizational chart of FIG. 6 in the wale direction in such a way as to approximate an actual knitted fabric.

By feeding the yarn five times to knitting needles 1 to p, the complete thick portion texture 10S, which is a texture made up of five wales of five yarns (small courses) C102 to C106, is knitted as indicated by the frames of the alternate long and short dash line in FIGS. 6 and 7. By tuck stitch formation (▲) in five spots, five double-loop portions W1, W2, . . . , W5 are formed by knit loops N1, N2, . . . , N5 and tuck loops T1, T2, . . . , T5 superposed on each other. The five double-loops differ from one another in the combination of yarns (small courses) in which the tuck loops and knit loops exist and yarns in which the tuck loops exist. However, as shown in FIG. 7, the five double-loops present an appearance similar to that of plain-knitted texture on the upper side by being arranged in the course direction as if the double-loops were knitted by a knitting yarn of the same small course. On the other hand, on the back side of the five double-loops, ten jump stitches A1, . . . , A10 are formed, extending to the left and right from tuck loops T1, T2, . . . , T5 of the double-loop portions W1, . . . , increasing the thickness of the thick portions 4, 5, 6.

Note that in FIG. 6, codes L to P denote wales knitted by knitting needles 1 to p on the needle bed B on the rear side, respectively. Also, course C0 is plain-knitted on front and rear needle beds (knitting method is not illustrated) prior to small course C102 when toes are knitted in FIG. 2. However, course C0 is not limited to plain knitting, and any publicly known knitted texture may be used as appropriate as long as when step S1 is started, loops are hooked to all the knitting needles h to u for which yarn feeding is repeated five times.

Once course C1 is knitted in step S1, step S1 is repeated again to knit course C2 made of the same texture as C1.

(Reverse Plating Step S2)

Once course C2 is knitted, course C3 is knitted by carrying out a reverse plating step S2. Course C3 includes the transverse grooves 4*a*.

In the reverse plating step S2, first, in substep S201, by feeding a knitting yarn to all the needles from knitting needle a to knitting needle ab on the needle bed F on the front side, knit stitch formation (○) is performed to plain-knit a half a circumference of the sock 10 on the instep side, and then in substep S202, after reversing the yarn feeding direction, by feeding a yarn to all the needles from knitting needle ab to knitting needle a on the needle bed B on the rear side as well, plain-knitted texture is formed by knit stitch formation. However, of the knitting needles on the rear side, regarding knitting needles u to h (see marks ⊙ in FIG. 2), by reversing the order of a back yarn carrier and a face yarn carrier, the back yarn carrier is caused to go ahead to feed the back yarn first to the knitting needles. Consequently, the SCY of the back yarn appears on the upper side and a shrinkage force of the back yarn presses down the knitted fabric, forming the transverse grooves 4*a*.

Following the knitting of course C3, step S1 and reverse plating step S2 are carried out as with course C1 to course C3 to knit course C4 to course C6.

(Thick Portion Knitting Steps S3 to S4)

In subsequent courses C7 to C12, knitting is done by carrying out step S3 and reverse plating step S4 as shown in FIG. 2. Step S3 is similar to step S1 except that the range of knitting needles for which yarn feeding is repeated five times in substeps S302 to S306 is expanded to a range of knitting needles f to w by increasing the knitting needles by two each on opposite ends of the needle row compared to step S1. Courses C7 and C8 are knitted by repeating step S2 twice.

Next, course C9 is knitted by the reverse plating step S4. Step S4 is similar to step S2 except that the range of knitting needles for which the back yarn carrier is caused to go ahead is expanded to a range of knitting needles f to w by increasing the knitting needles by two each on the opposite ends of the needle row compared to step S2.

Subsequent courses C10 to C12 are knitted by steps S3 and S4 as with courses C7 to C9.

(Thick Portion Knitting Steps S5 to S8)

Subsequently, as shown in FIGS. 2 and 3, by expanding, as appropriate, the range of knitting needles for which yarn feeding is repeated five times and the range of knitting needles for which the back yarn carrier is caused to go ahead, steps S5 to S8 are carried out using a knitting method similar to steps S1 to S4 to form courses C13 to C24.

(Knitting of Fork Legs 4*b* and 4*c*)

Subsequent courses C25 to C33 are knitted by forming the fork legs 4*b* and 4*c* of the ball-of-the-foot portion 4 and thin indented portion 9*a* shown in FIG. 1 as well as an instep portion (not illustrated) continuous therewith in a circumferential direction and carrying out each of steps S9 to S14 (described later) once or twice.

(Thick Portion Knitting Step S9)

In the thick portion knitting step S9, a half the circumference on the instep side is knitted in substep S901 and a half the circumference on the sole side is knitted in substeps S902 to S910.

Specifically, first in substep S901, by feeding a knitting yarn to all the needles on the front-side needle bed, and the instep portion is plain-knitted by knit stitch formation (○). In subsequent substeps S902 to S906, the fork leg 4*b* on the inner side of the foot is knitted by repeating yarn feeding to knitting needles s to ab five times while alternating the yarn feeding directions.

In substeps S902 to S906, as with substeps S102 to S106, while the yarn is fed five times by changing the yarn feeding direction, knit stitch formation (●) is performed once, tuck stitch formation (▲) is performed once, and miss stitch formation (-) is performed three times on every needle row of successive five needles out of knitting needles ab to s in each substep, and thus knit stitch formation (●) is performed once, tuck stitch formation (▲) is performed once, and miss stitch formation (-) is performed three times (n−3=2 or above) per knitting needle. This results in a texture continuously repeating the stitch texture of the complete thick portion texture 10S.

In the first half of substep S906, the fork leg 4*b* on the inner side of the foot is knitted on knitting needles ab to s by a mixture of knit stitch formation (●), tuck stitch formation (▲), and miss stitch formation, and then the thin indented portion 9*a* is plain-knitted using knitting needles r to k.

Then, from the second half of substep S906 to substep S910, by repeating yarn feeding five times to knitting needles j to a while changing the yarn feeding direction, the outer fork leg 4*c* is knitted. Also, in substep S906 to substep S910, a texture made up of a continuous stitch texture is knitted as with the complete thick portion texture 10S.

After course C25 is knitted in step S9, course C26 made of the same texture as C25 is knitted by repeating step S9 again.

(Reverse Plating Step S10)

After course C26 is knitted, course C27 provided with the transverse grooves 4*a* is knitted by carrying out step S10.

In step S10, as in S2, the transverse grooves 4*a* are knitted by reversing the order of the back yarn carrier and face yarn carrier, thereby causing the back yarn carrier to go ahead, and thereby feeding the back yarn first to the knitting needles indicated by ⊙ in FIG. 3.

(Thick Portion Knitting Steps S11 to S13)

Next, courses C28 to C33 are knitted by carrying out steps S11 to S14 as with steps S9 and S10 by reducing, as appropriate, the number of knitting needles used to knit the inner fork leg 4*b*, the number of knitting needles used to knit the outer fork leg 4*c*, and the number of knitting needles for which the back yarn carrier is caused to go ahead. This completes knitting of the ball-of-the-foot portion 4.

(Thin Portion Knitting Step S15)

When the knitting of the ball-of-the-foot portion 4 is finished, the thin transverse boundary portion 9*c* between the ball-of-the-foot portion 4 and the arch-of-the-foot portions 5 and 6 is plain-knitted in a thin portion knitting step S15 (see courses C34 and C35 in FIG. 4).

(Thick Portion Knitting Step S16)

The knitting of the inside-arch-of-the-foot portion 5 and the outside-arch-of-the-foot portion 6 begins with knitting a front end portion 5*a* of the inside-arch-of-the-foot portion 5 by carrying out step S16. In step S16, first the instep is plain-knitted in substep S1601, and then in substeps S1602 to S1606, the front end portion 5*a* of the inside-arch-of-the-foot portion 5 is knitted into a continuous stitch texture as with the complete thick portion texture 10S by repeating yarn feeding to knitting needles ab to p five times.

Courses C36 to C39 are knitted by repeating step S16 four times.

(Thick Portion Knitting Steps S17 to S24)

In thick portion knitting steps S17 to S24, a rear portion 5*b* of the inside-arch-of-the-foot portion 5 and the outside-arch-of-the-foot portion 6 are knitted simultaneously on opposite sides of the thin longitudinal boundary portion 9*b*.

In step S17, first in substep S1701, by feeding a knitting yarn to all the needles on the front-side needle bed F, the instep portion is plain-knitted by knit stitch formation (○). In substeps S1702 to S1706 next, the rear portion 5*b* of the inside-arch-of-the-foot portion 5 is knitted by repeating yarn feeding to knitting needles ab to p five times while alternating the yarn feeding directions, then in the middle of substep S1706, the rear portion 5*b* is plain-knitted by performing knit stitch formation (●) using all the knitting needles o to g, and consequently the thin longitudinal boundary portion 9*b* is knitted.

Then, from the second half of substep S1706 to substep S1710, by repeating yarn feeding five times to knitting needles f to a while changing the yarn feeding direction, the outside-arch-of-the-foot portion 6 is knitted.

The knitting of the inside-arch-of-the-foot portion 5 and the outside-arch-of-the-foot portion 6 in step S17 also produces a texture repeating a stitch texture similar to the complete thick portion texture 10S as with substeps S102 to S106 of step S1.

Courses C40 and C41 are knitted by repeating step S17 twice.

Subsequently, in steps S18 to S24 of knitting courses C42 to C55, knitting is done in a manner similar to step S17 except that the numbers of knitting needles used to knit the inside-arch-of-the-foot portion 5, the outside-arch-of-the-foot portion 6, and the thin longitudinal boundary portion 9*b* are changed as appropriate. In steps S21 to S24 (courses C48 to C55), knitting is done to provide the thin inside portion 9*d* on the inner side of the inside-arch-of-the-foot portion 5. When the knitting of the inside-arch-of-the-foot portion 5 and the outside-arch-of-the-foot portion 6 is finished, course C56 is plain-knitted in step S25 by feeding a knitting yarn orbitally to all the knitting needles on the front and rear needle beds.

Note that although no transverse groove 4*a* is provided in the inside-arch-of-the-foot portion 5 and the outside-arch-of-the-foot portion 6, transverse grooves 4*a* may be provided as with the ball-of-the-foot portion 4.

Second Embodiment

Figure 8:
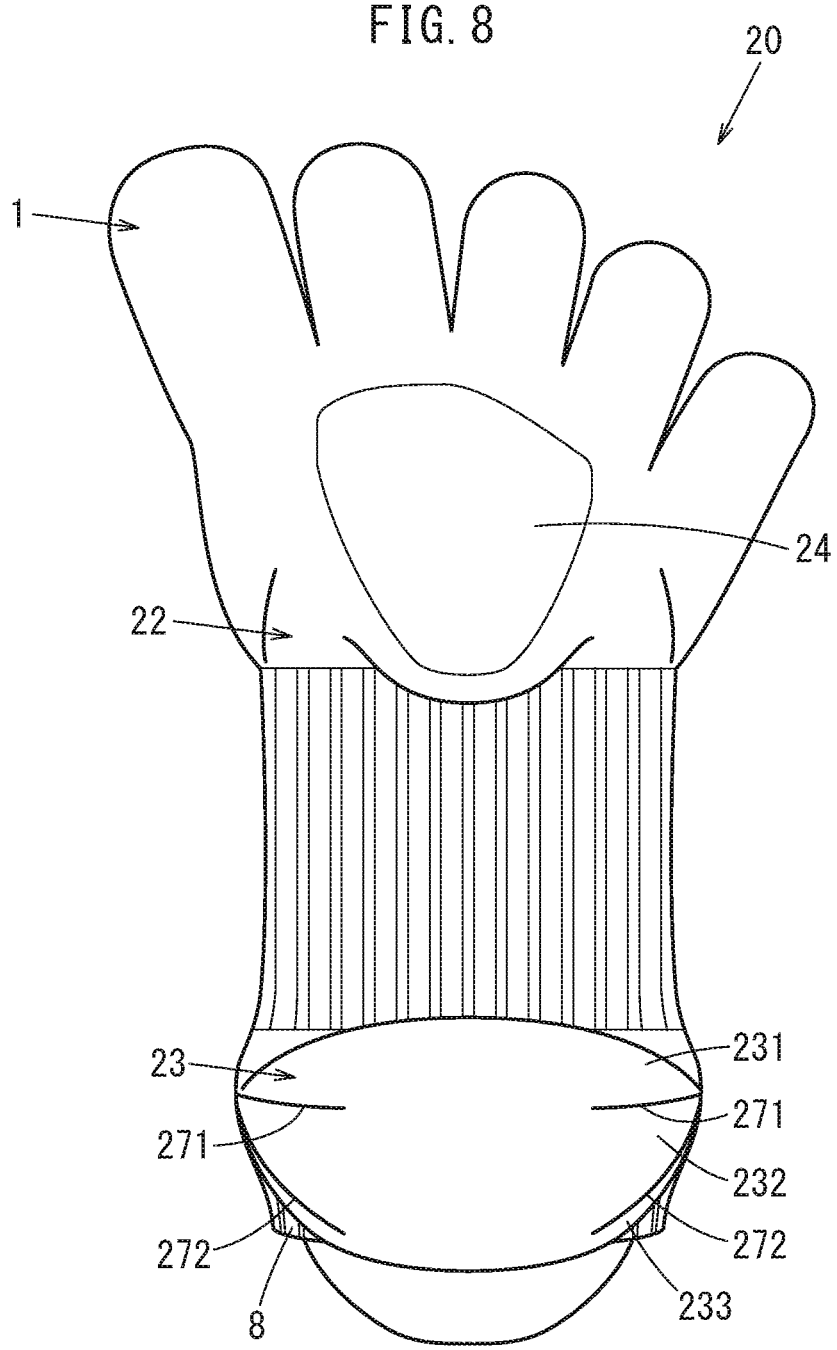
FIG. 8 is a bottom view of weft knitted fabric according to a second embodiment of the present invention, the knitted fabric having thick portions.

FIG. 8 shows a sock 20 made of weft knitted fabric according to a second embodiment of the present invention, the knitted fabric having thick portions. The sock 20 mainly includes a toe portion 1, a foot portion 22, a heel portion 23, and a cuff 8 and is knitted by a flat knitting machine equipped with a pair of front and back needle beds F and B. Of the sock 20, a ball-of-the-foot portion 24 on the sole side and the heel portion 23 are formed into thick portions.

Note that in the second and subsequent embodiments, parts in common with the first embodiment are denoted by the same codes as the corresponding components in the first embodiment, and description thereof will be omitted.

The ball-of-the-foot portion (thick portion) 24 is provided at a base of three toes from the second to fourth toes and shaped like a fan tapering rearward. The ball-of-the-foot portion 24 is knitted by a knitting method similar to the knitting method for the inside-arch-of-the-foot portion 5 and outside-arch-of-the-foot portion 6 according to the first embodiment and is not provided with transverse grooves 4*a*.

Note that a knitting diagram of the ball-of-the-foot portion 24 is omitted.

The heel portion 23 is divided in a forward-backward direction into a front heel portion 231, a middle heel portion 232, and a rear heel portion 233 by a pair of left and right front gore lines 271 and a pair of left and right rear gore lines 272.

FIGS. 9 and 10 show a knitting method for the heel portion 23. The heel portion 23 is knitted in thick portion knitting steps S26 to S30 carried out following the knitting of the foot portion 22. Note that in the heel portion 23, a texture knitted by reversing the yarn feeding direction five times will be described as being one course for the sake of convenience.

(Reduced-Width Portion Knitting Step S26)

In a reduced-width portion knitting step S26, the front heel portion 231 is knitted.

In substep S2601, as shown in FIG. 9, by moving the yarn carrier to the left, tuck stitch formation (▲) is performed using knitting needle ab on the rear needle beds and then knitting needles aa to a are manipulated repeatedly in the order: Knit (●), Miss (-), Tuck (▲), Miss (-) and Miss (-).

In substep S2602, by moving the yarn carrier to the right, tuck stitch formation (▲) is performed using knitting needle a, and then by shifting the positions of Knit (●) and Miss (-) leftward by one knitting needle from substep S2601, Knit (●), Tuck (▲) and Miss (-) are similarly repeated on knitting needles b to aa. In substep S2602, the number of knitting needles targeted for yarn feeding is decreased by one compared to substep S2601.

Subsequently, in substep S2603 to substep S2605, by decreasing the number of knitting needles by one each time the yarn feeding direction is reversed, knit stitch formation (●) and tuck stitch formation (▲) are performed by shifting position one knitting needle leftward compared to the previous substep, and consequently course C201 is knitted.

In knitting course C201, as shown in the solid frame of FIG. 9, a knitting method similar to the knitting method for the complete thick portion texture 10S according to the first embodiment is used for a part knitted by knitting needles v to z, and on the other knitting needles, knitting is repeated to form such a continuous stitch texture as the complete thick portion texture 10S.

Subsequently, in substeps S2606 to S2638, by gradually reducing the knitting needles targeted for yarn feeding and shifting the positions of Knit (●) and Tuck (▲) needle by needle leftward, courses C202 to C208 are knitted.

Note that although in the present embodiment, in some substeps such as substeps S2606 and S2607, the knitting needles targeted for yarn feeding are increased compared to the previous substep to make the front heel portion 231 puffy by increasing the number of courses, the knitting needles targeted for yarn feeding may be decreased in every substep compared to the previous substep.

Then, in substep S2639, knitting is done by shifting the positions of Knit (●) and Tuck (▲) one needle leftward compared to substep S2738 and feeding a yarn to knitting needles u to a, then in substep S2740, by turning the yarn feeding direction to the right on the front-side needle bed F, knit stitch formation (○) is performed by feeding a yarn to all of needles a to ab, and consequently a half the circumference which is to become the instep is plain-knitted.

(Gore Line Knitting Step S27)

In a gore line knitting step S27, a pair of left and right front gore lines 271 are knitted. According to the present embodiment, the front gore lines 271 are also knitted as thick portions. In step S27, a knitting method similar to that for the complete thick portion texture 10S is performed in a range of knitting needle a to knitting needle ab. In so doing, plural loops kept hooked to knitting needles a to h and knitting needles u to ab during tuck stitch formation (▲) when the yarn feeding direction is reversed in step S26 are connected to the loops formed by knit stitch formation (●) in the gore line knitting step S27 and the resulting connecting portions are formed into the front gore line 271. For example, a double-loop kept hooked to knitting needle a by tuck stitch formation (▲) on knitting needle a in substep S2602 is turned into a triple-loop by tuck stitch formation (▲) on knitting needle a in substep S2701 and then connected to a knit loop formed by knit stitch formation (●) on knitting needle a in substep S2703.

(Reduced-Width Portion Knitting Step S28)

In a reduced-width portion knitting step S28, as shown in FIG. 10, the middle heel portion 232 made up of courses C210 to C216 is knitted after the front gore lines 271 are knitted in step S27.

In step S28, as with step S26 of knitting the front heel portion 231, by gradually reducing the knitting needles targeted for yarn feeding, knitting similar to the knitting of the complete thick portion texture 10S according to the first embodiment is repeated.

Just after the reduced-width portion knitting step S28 is finished, plural loops remain hooked to knitting needles a to g and knitting needles u to ab as a result of tuck stitch formation (▲).

(Gore Line Knitting Step S29)

In a gore line knitting step S29, the rear heel portion 233 and the rear gore lines 272 are knitted. In step S29, as shown in FIG. 10, first in substep S2901, with the yarn feeding direction set to the right direction, tuck stitch formation (▲) is performed on knitting needle h and knit stitch formation (●) is performed on knitting needle i, and then knitting needles j to v are manipulated repeatedly in the order: Miss (-), Miss (-), Knit (●), and Knit (●). Then, in subsequent substeps S2902 to S2915, knit stitch formation (●) and miss stitch formation (-) are repeated by shifting positions by two needles leftward compared to the previous substep. In so doing, by increasing the knitting needles targeted for yarn feeding each time the yarn feeding direction is reversed, tuck stitch formation (▲) is performed at the position where the yarn feeding direction is reversed.

The rear heel portion 233, in which a pseudo-pile-shaped jump stitches are formed by two successive runs of miss stitch formation (-), becomes thicker than a part plain-knitted by all needles, but is thinner than the front heel portion 231 and middle heel portion 232.

In step S29, at the positions where the yarn feeding direction is reversed the loops left hooked to knitting needles a to g and knitting needles u to ab in step S28 are connected to loops formed by knit stitch formation (●), and consequently the rear gore lines 272 is formed.

Next, a third to seventh embodiments, which concern a case in which n=7 in the claims, will be described.

Third Embodiment

FIG. 11 shows a knitting method for thick portions according to a third embodiment of the present invention. In the third embodiment, a complete thick portion texture 30S made up of seven wales by seven subcourses is knitted in substeps S3102 to S3108 by feeding the yarn seven times to a needle row made up of seven adjacent knitting needles g to m while alternating the yarn feeding directions.

In the third embodiment, in all steps excluding substep S3106, knit stitch formation (●) and tuck stitch formation (▲) are performed once each and miss stitch formation (-) is performed five times while in substep S3106 alone, knit stitch formation (●) is performed twice, tuck stitch formation (▲) is performed once, and miss stitch formation (-) is performed four times.

That is, in the third embodiment, the group of substeps S3102 to S3108 in which the complete thick portion texture 30S is knitted corresponds to that case in the claims in which the thick portion knitting substep is carried out once using three knitting needles in total for the knit stitch formation (●) and the tuck stitch formation (▲).

Also, on all of knitting needles g to m except knitting needle i, knit stitch formation (●) and tuck stitch formation (▲) are performed once each and miss stitch formation (-) is performed five times while on knitting needle i, knit stitch formation (●) is performed twice, tuck stitch formation (▲) is performed once, and miss stitch formation (-) is performed four times.

That is, in the third embodiment, the group of substeps S3102 to S3108 in which the complete thick portion texture 30S is knitted corresponds to that case in the claims in which the number of knitting needles used to perform the knit stitch formation and the tuck stitch formation three times in total is one.

Fourth Embodiment

Of substeps S4002 to S4008 involved in knitting a complete thick portion texture 40S according to a fourth embodiment as shown in FIG. 12, in all the substeps excluding substep S4008, knit stitch formation (●) and tuck stitch formation (▲) are performed once each and miss stitch formation (-) is performed five times while in substep S4008 alone, tuck stitch formation (▲) is performed twice, knit stitch formation (●) is performed once, and miss stitch formation (-) is performed four times. Also, in substeps S4002 to S4008, on all of knitting needles g to m except knitting needle i, knit stitch formation (●) and tuck stitch formation (▲) are performed once each and miss stitch formation (-) is performed five times while on knitting needle i, tuck stitch formation (▲) is performed twice, knit stitch formation (●) is performed once, and miss stitch formation (-) is performed four times.

Note that the reason why substeps S4009 to S4016 are shown together in FIG. 12 is to show an example in which successive runs of tuck stitch formation (▲) as with knitting needle i in substeps S4008 and S4010 result in formation of a triple-loop.

Fifth Embodiment

In knitting a complete thick portion texture 50S according to a fifth embodiment, as shown in FIG. 13 and as with the first and second embodiments, knit stitch formation (●) and tuck stitch formation (▲) are performed once each on every knitting needle as well as in every substep, and miss stitch formation (-) is performed for all the remaining stitches. However, whereas in the first and second embodiments, the knitting needles used for tuck stitch formation (▲) and miss stitch formation (-) are shifted one needle leftward from the previous substep, in the fifth embodiment, the knitting needles used for knit stitch formation (●) and tuck stitch formation (▲) have no relation to the knitting needles used for knit stitch formation (●) and tuck stitch formation (▲) in the previous substep.

In the knitting method for weft knitted fabric having thick portions according to the present invention, as with the third to fifth embodiments, preferably, of n thick portion knitting substeps, the number of substeps in which knit stitch formation (●) and tuck stitch formation (▲) are performed three times in total is one or less. This makes it possible to form knitted fabric that almost does not differ in thickness and texture from when knit stitch formation (●) and tuck stitch formation (▲) are performed only once each in every substep.

Sixth Embodiment

In knitting a complete thick portion texture 60S according to a sixth embodiment, as shown in FIG. 14 and as with the first and second embodiments, knit stitch formation (●) and tuck stitch formation (▲) are performed once each in every substep, and miss stitch formation (-) is performed for all the remaining stitches. Also, in knitting the complete thick portion texture 60S, knit stitch formation (●) and tuck stitch formation (▲) are performed once each on every knitting needle, and miss stitch formation (-) is performed for all the remaining stitches. However, whereas in the first and second embodiments, the knitting needles used for tuck stitch formation (▲) and miss stitch formation (-) are shifted one needle leftward from the previous substep in every substep, in the sixth embodiment, only the knit stitch formation (●) is shifted one needle leftward from the previous substep, the knitting needles used for tuck stitch formation (▲) have no relation to the knitting needles used for tuck stitch formation (▲) in the previous substep.

Seventh Embodiment

In a complete thick portion texture 70S of a thick portion 70 according to a seventh embodiment shown in FIG. 15, as with the first and second embodiments, knit stitch formation (●) and tuck stitch formation (▲) are performed once each in every substep, and miss stitch formation (-) is performed for all the remaining stitches. Also, in the complete thick portion texture 70S, knit stitch formation (●) and tuck stitch formation (▲) are performed once each on every knitting needle, and miss stitch formation (-) is performed for all the remaining stitches. In the complete thick portion texture 70S, as with the first and second embodiments, in every substep, the knitting needles used for tuck stitch formation (▲) and miss stitch formation (-) are shifted one needle leftward from the previous substep.

As with the third to seventh embodiments, in one thick portion knitting step, by repeating the thick portion knitting substep seven times using seven adjacent knitting needles, the thickness of the thick portion can be increased.

The knitting method for weft knitted fabric having thick portions according to the present invention is not limited to the above embodiments, and the integer n is not limited to 5 and 7, and may be 6 or 8 or above. For example, if n=6, the complete thick portion texture can be knitted by carrying out six thick portion knitting substeps on six successive knitting needles while repeatedly changing direction, by performing knit stitch formation (●) once or twice, tuck stitch formation (▲) once or twice, and miss stitch formation (-) three or more times in each substep, and performing knit stitch formation (●) once or three times, tuck stitch formation (▲) once or twice, and miss stitch formation (-) three or more times on each of the six knitting needles.

Also, the present invention is applicable not only to socks, but also weft knitted fabric other than socks. When the present invention is applied to socks, the socks are not limited to 5-toe socks, and may be normal socks. Also, the socks may have four or less toes or may be toeless socks. Thick portions may be provided on the instep side of the socks or at one location or four or more locations on the sole side of the socks.

What is claimed is:

1. A knitting method for forming a weft knitted fabric having a thick portion, the knitting method comprising:

a thick portion knitting step of forming at least two complete thick portion textures in one course of the weft knitted fabric by continuously repeating a thick portion knitting substep while alternating yarn feeding directions, the thick portion knitting sub step including feeding a knitting yarn once to a needle row of five successive knitting needles in one direction, wherein:

the thick portion knitting step includes: (i) knitting a first of the at least two complete thick portion textures; (ii) after knitting the first of the at least two complete thick portion textures, knitting a plain-knitting portion by feeding the knitting yarn in one direction to other knitting needles than those used to knit the at least two complete thick portion textures; and (iii) after knitting the plain-knitting portion, knitting a second of the at least two complete thick portion textures;

in the thick portion knitting substep, knit stitch formation is performed on one knitting needle of the five successive knitting needles, tuck stitch formation is performed on another knitting needle of the five successive knitting needles, and miss stitch formation is performed on at least two other knitting needles of the five successive knitting needles; and in a process of forming each of the at least two complete thick portion textures, on each of the five successive knitting needles, the knit stitch formation is performed once, the tuck stitch formation is performed once, and the miss stitch formation is performed at least twice.

2. The knitting method according to claim 1, wherein:

the knitting yarn is made up of a face yarn, which is a non-elastic yarn, and a back yarn, which is an elastic yarn; and the knitting method further comprises a reverse plating step of doing knitting by reversing an order of a yarn carrier adapted to feed the face yarn and a yarn carrier adapted to feed the back yarn for at least some of the five successive needles between two preceding and following runs of the thick portion knitting step.

* * * * *